United States Patent [19]

Van Amsterdam

[11] 4,035,598

[45] * July 12, 1977

[54] APPARATUS FOR THERMALLY TREATING POLYMERIC WORKPIECES WITH MICROWAVE ENERGY

[75] Inventor: Cornelis Johannes Maria Van Amsterdam, Viersen, Germany

[73] Assignee: Johannes Menschner Maschinenfabrik GmbH & Co. KG., Dulken, Germany

[ * ] Notice: The portion of the term of this patent subsequent to Oct. 22, 1991, has been disclaimed.

[21] Appl. No.: 596,856

[22] Filed: July 17, 1975

Related U.S. Application Data

[63] Continuation-in-part of Ser. No. 516,974, Oct. 22, 1974, abandoned, which is a continuation of Ser. No. 385,440, Aug. 3, 1973, Pat. No. 3,843,861, which is a continuation of Ser. No. 140,057, May 4, 1971, abandoned.

[51] Int. Cl.[2] ..... H05B 9/06

[52] U.S. Cl. ..... 219/10.55 A; 219/10.55 F

[58] Field of Search ..... 219/10.55 A, 10.55 R, 219/10.55 F; 333/95 R

[56] References Cited

U.S. PATENT DOCUMENTS

| | | | |
|---|---|---|---|
| 3,465,114 | 9/1969 | Bleackley et al. | 219/10.55 A |
| 3,555,232 | 1/1971 | Bleackley | 219/10.55 A |
| 3,843,861 | 10/1974 | Van Amsterdam | 219/10.55 A |

*Primary Examiner*—Bruce A. Reynolds
*Attorney, Agent, or Firm*—Ernest G. Montague; Karl F. Ross; Herbert Dubno

[57] ABSTRACT

A prismatic waveguide of square or rectangular cross-section has at least one pair of opposite inner wall surfaces formed with inwardly projecting parallel cheeks extending along a treatment zone for elongate polymeric workpieces, the width of the cheeks being less than the spacing of the other pair of inner wall surfaces from each other. The waveguide is split along a median parting plane, bisecting this pair of cheeks, to facilitate separation of its two halves by relative tilting about a pivotal axis, the two halves adjoining each other along quarter-wavelength flanges parallel to that plane preventing the outward leakage of microwave energy.

6 Claims, 4 Drawing Figures

APPARATUS FOR THERMALLY TREATING POLYMERIC WORKPIECES WITH MICROWAVE ENERGY

CROSS-REFERENCE TO RELATED APPLICATIONS

This is a continuation-in-part of my copending application Ser. No. 516,974, filed Oct. 22, 1974, abandoned, as a continuation of my prior application Ser. No. 385,440 filed Aug. 3, 1973, now U.S. Pat. No. 3,843,861, a continuation of Ser. No. 140,057, filed May 4, 1971, now abandoned.

FIELD OF THE INVENTION

My present invention relates to an apparatus for the thermal treatment of goods, in particular of extruded profiles or rubber or synthetic material in elongate strands, which are guided in a continuous passage through a field of microwave energy propagated in a waveguide.

BACKGROUND OF THE INVENTION

In the practice of thermal treatment of profiles of rubber or synthetic material, the poor thermal conductivity of such material causes appreciable difficulties in attempting to equalize the heat distribution throughout the profiles since the externally applied heat penetrates but slowly to the core of the workpiece.

In recognition of these difficulties, microwave energy has been used to make possible uniform heating of the profile.

Rectangular waveguides, operating in the $H_{10}$ (or $TE_{10}$) mode, or circular waveguides, operating in the $E_{01}$ (or $TM_{01}$) mode, are only limitedly useful for this purpose, though in the vulcanization or cross-linking of polymeric profiles somewhat satisfactory results can be achieved with waveguides of the latter type if the profile to be treated does not surpass a predetermined thickness, up to a diameter of about 30 mm in the case of round workpieces.

It is, however, important in practice to be able to apply such vulcanization and cross-linking also to larger polymeric profiles, e.g. of a cross-section of about 50 × 50 mm or more, for which the known teachings are unsuitable.

OBJECT OF THE INVENTION

It is therefore the object of my present invention to provide a waveguide structure enabling the use of microwave energy in the thermal treatment of rubber or synthetic profiles of larger cross-section.

SUMMARY OF THE INVENTION

This object is realized, in accordance with my present invention, by continuously passing the workpieces to be treated through a four-sided waveguide wherein at least one pair of opposite wall surfaces are stepped to form two inwardly projecting, flat, parallel cheeks extending symmetrically over the length of a treatment zone defined thereby, these cheeks being inegral with integral conductive structure of the waveguide and having a width which is less than the spread of its other pair of opposite wall surfaces.

If the waveguide has a rectangular cross-section, the cheeks are disposed along the major sides of the rectangule. With a square cross-section, two mutually orthogonal pairs of cheeks are provided which are separated from one another at the corners of the square by longitudinally extending quarter-wavelength recesses.

The waveguide may be longitudinally split into two symmetrical halves, along a median parting plane perpendicular to the faces of a cheek pair, so as to be capable of swinging open by a relative tilting of these halves about a longitudinal or transverse pivotal axis, the two halves adjoining each other along quarter-wavelength flanges integral therewith.

BRIEF DESCRIPTION OF THE DRAWING

These and other features of the present invention will be described in greater detail with reference to the accompanying drawing in which.

SPECIFIC DESCRIPTION

Figure 1:
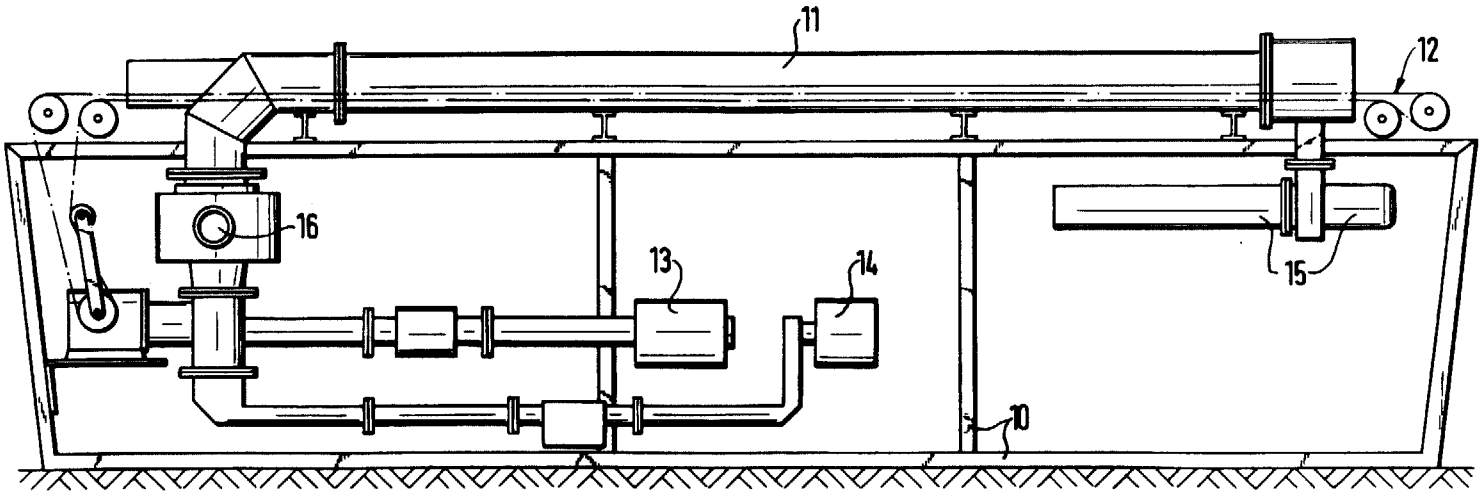
FIG. 1 is a side-elevational view of a treatment apparatus embodying my invention.

The apparatus shown in FIG. 1 comprises a machine frame 10 on which a waveguide 11 is mounted, this waveguide being longitudinally traversed by a conveyor 12 carrying the elongate workpieces (not shown) to be thermally treated. A heater 15 introduces hot air into the waveguide at its righthand end, the spent air being discharged from the opposite end at a port 16.

Figure 2:
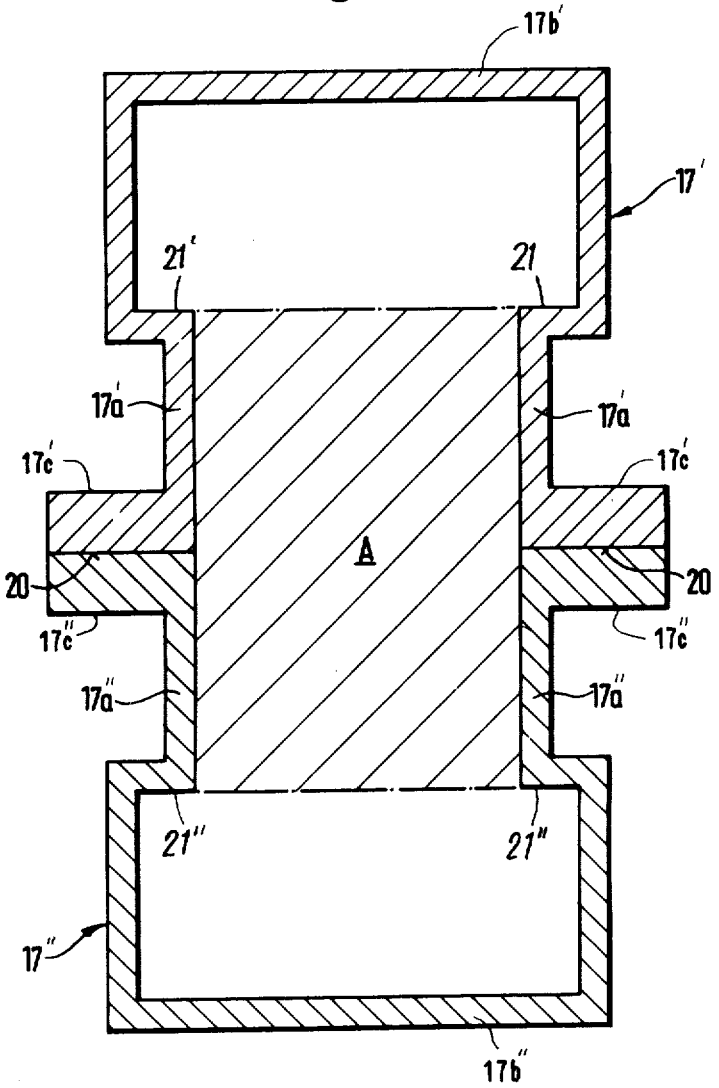
FIG. 2 is a cross-sectional view, drawn to a larger scale, of a waveguide forming part of the apparatus of FIG. 1.
Figure 4:
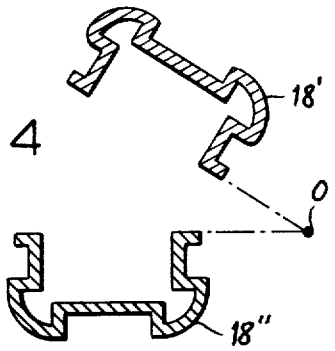
FIG. 4 is a cross-sectional view of the waveguide of FIG. 1, drawn to a smaller scale, with its two halves separated.
Figure 3:
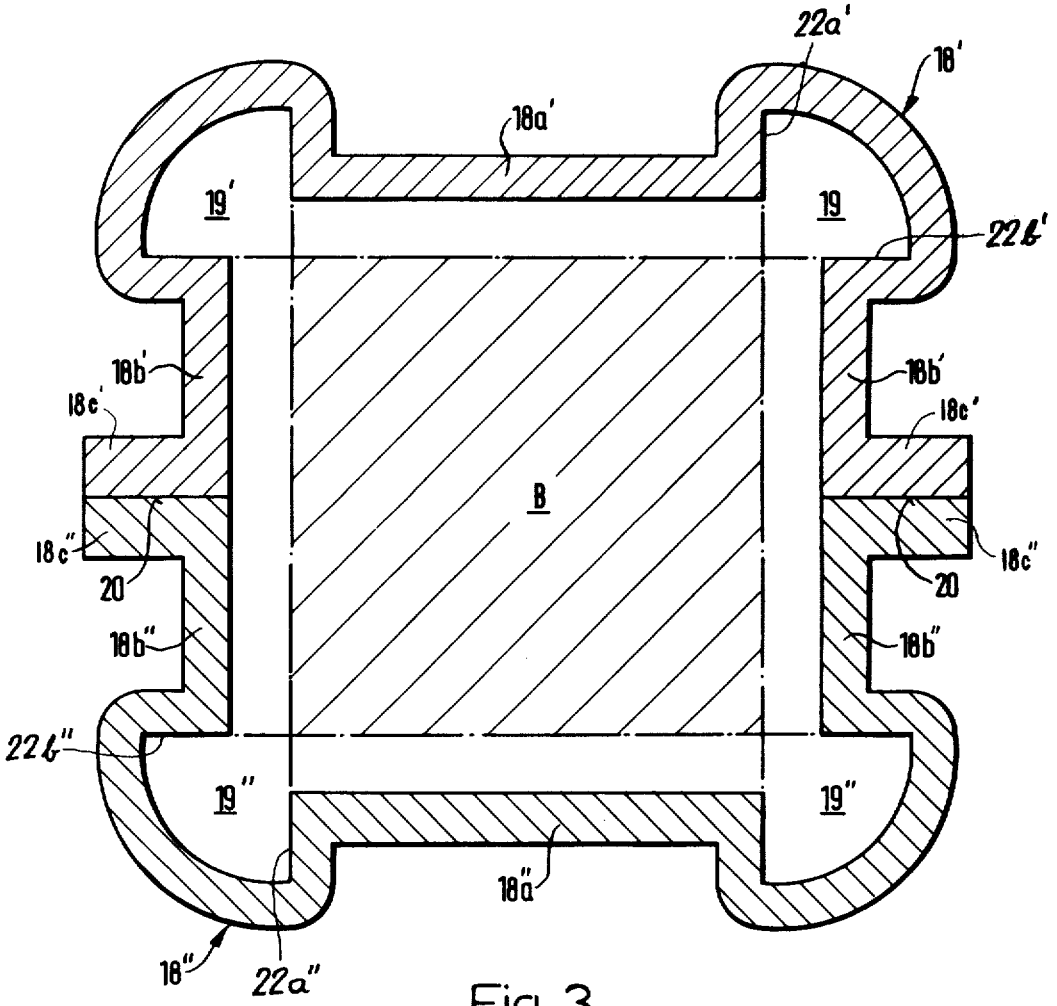
FIG. 3 is a view similar to FIG. 2, illustrating a modified waveguide.

The waveguide 11, whose structure will be more fully described hereinafter with reference to FIGS. 2 – 4, is energized with microwave energy by a pair of magnetrons 13 and 14 also mounted on the machine frame 10. Thus, the workpieces passing through the waveguide on conveyor 12 are superficially heated by the hot air from device 15 and are subjected to more intense and uniform heating by the mirowave energy propagated within the guide.

FIG. 2 shows the rectangular cross-section of a conductive wall structure 17', 17'' adapted to be used as the waveguide 11 of FIG. 1. The major sides of the rectangle are stepped at 21', 21'' so as to form a pair of flat, parallel cheeks, each divided into two sections **17*a'* and 17*a''*, projecting toward each other from the inner wall surface of the guide to define a treatment zone A within which the conveyed workpieces are subjected to intense heating by the electric field developed across the cheek faces. The two halves 17' and 17'' of the structure are symmetrical and adjoin each other along a parting plane 20 perpendicular to the faces of cheeks 17*a'* and 17*a''* which are integral with the wall structure 17', 17'' and with respective quarter-wavelength flanges 17*c'*, 17*c''* extending parallel to the plane 20. The width of cheeks 17*a'*, 17*a''* is less than the spacing of the minor sides 17*b'*, 17*b''*** of the rectangle.

FIG. 3 shows a generally similar wall structure of square cross-section with halves 18' and 18'' adjoining each other again along a parting plane 20. Integral sections **18*a'*, 18*b'* and 18*a''*, 18*b''* of these halves bounded by steps 22*a'*, 22*b'* and 22*a''*, 22*b''*, form two mutually orthogonal pairs of cheeks defining between them a treatment zone B within which their respective electric fields intersect. Adjacent cheeks are separated from one another by quarter-wavelength recesses 19', 19'' extending longitudinally of the guide between neighboring surface steps 22a', 22b' in half 18' and 22a'', 22b'' in half 18'', the short-circuiting of the outer wall portions of these recesses creating a high impedance between neighboring cheek edges to prevent sparking and interaction between the two orthogonal fields which are generated by separate microwave sources such as the two magnetrons 13 and 14 of FIG. 1. The wall structure of FIG. 3 with its two cheek pairs enables a more intense heating of the workpieces, compared with that of FIG. 2,** so that shorter waveguides may be used in this instance.

Cheek sections 18b' and 18b'' are integral with quarter-wavelength flanges 18c' and 18c'' which, like the corresponding flanges 17c' and 17c'' of FIG. 2, prevent the outward leakage of microwave energy. This is true because, as will be apparent to persons skilled in the art, the presence of any gap between the inner edges of these flanges would result in an effective short-circuiting of their outer edges so that no microwave energy would be radiated from these outer edges even if the guide were not completely closed. The separability of the halves 17', 17'' or 18', 18'' makes the conveyor path within the waveguide readily accessible.

The possibility of separating the two waveguide halves from each other along parting plane 20 has been particularly illustrated for the structure of FIG. 3 in FIG. 4 which shows the two halves 18' and 18'' relatively tilted about a longitudinal pivotal axis 0.

The separation of the two continuous cheeks 18a', 18a'' in FIG. 3 is less than the width of the split cheeks 18b', 18b'', and vice versa. The spacings and the widths are the same for both pairs, yet this is not essential.

I claim:

1. An apparatus for the thermal treatment of elongate polymeric workpieces, comprising:

a waveguide with a conductive peripheral wall structure of four-sided cross-section forming a treatment zone between mutually perpendicular first and second pairs of opposite wall surfaces, said first pair of wall surfaces being stepped to form two flat, inwardly projecting parallel cheeks integral with said wall structure extending symmetrically over the length of said treatment zone and having a width less than the spacing of said second pair of wall surfaces, said wall structure being split into two symmetrical halves along a median parting plane, perpendicular to the faces of said cheeks, for enabling separation of said halves from each other;

feed means for passing said workpieces through said treatment zone; and energizing means for propagating mirowave energy through said waveguide.

2. An apparatus as defined in claim 1 wherein said halves are relatively tiltable about a pivotal axis.

3. An apparatus as defined in claim 2 wherein said pivotal axis extends longitudinally of the waveguide.

4. An apparatus as defined in claim 1 wherein said halves adjoin each other along quarter-wavelength flanges parallel to said parting plane and integral with said wall structure.

5. An apparatus as defined in claim 1 wherein said cross-section is rectangular, said cheeks being disposed along the major sides of the rectangle and terminating short of the minor sides thereof.

6. An apparatus as defined in claim 1 wherein said cross-section is square, each of said pairs of wall surfaces being stepped to form flat, inwardly projecting cheeks integral with said wall structure having a width less than the spacing between the cheeks of the other pair of wall surfaces, adjoining cheeks being separated from one another by quarter-wavelength recesses extending longitudinally at the corners of the square.

* * * * *